US011248829B2

(12) United States Patent
Suzuki et al.

(10) Patent No.: US 11,248,829 B2
(45) **Date of Patent: *Feb. 15, 2022**

(54) APPARATUS USING A HEAT PUMP INCLUDING A REFRIGERANT LEAKAGE DETECTOR

(71) Applicant: Mitsubishi Electric Corporation, Tokyo (JP)

(72) Inventors: Yasuhiro Suzuki, Tokyo (JP); Hirokazu Minamisako, Tokyo (JP); Kazutaka Suzuki, Tokyo (JP); Takafumi Mito, Tokyo (JP); Taro Hattori, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 12 days.

This patent is subject to a terminal disclaimer.

(21) Appl. No.: 16/490,744

(22) PCT Filed: Jun. 9, 2017

(86) PCT No.: PCT/JP2017/021507

§ 371 (c)(1),
(2) Date: Sep. 3, 2019

(87) PCT Pub. No.: WO2018/225257

PCT Pub. Date: Dec. 13, 2018

(65) Prior Publication Data

US 2020/0080757 A1 Mar. 12, 2020

(51) Int. Cl.
*F25B 49/02* (2006.01)
*F25B 30/02* (2006.01)
(Continued)

(52) U.S. Cl.
CPC ..... *F25B 49/022* (2013.01); *F24D 11/02* (2013.01); *F24F 11/36* (2018.01); *F25B 30/02* (2013.01);
(Continued)

(58) Field of Classification Search
CPC .... F25B 49/022; F25B 2500/222; F24F 11/36
See application file for complete search history.

(56) References Cited

U.S. PATENT DOCUMENTS 5,351,500 A 10/1994 Morrow
6,615,597 B1 * 9/2003 Domyo ..... F25B 41/31 62/197
2018/0142931 A1 5/2018 Takagi

FOREIGN PATENT DOCUMENTS

CN 103797317 A 5/2014
CN 203837315 U 9/2014
(Continued)

OTHER PUBLICATIONS

International Search Report of the International Searching Authority dated Aug. 15, 2017 for the corresponding international application No. PCT/JP2017/021507 (and English translation).
(Continued)

*Primary Examiner* — Jonathan Bradford
(74) *Attorney, Agent, or Firm* — Posz Law Group, PLC

(57) ABSTRACT

An apparatus using a heat pump includes a refrigerant circuit and a heat medium circuit. The refrigerant circuit is capable of performing a first operation, in which a load-side heat exchanger is used as a condenser, and a second operation, in which the load-side heat exchanger is used as an evaporator. A main circuit of the heat medium circuit has a branching part and a joining part. An overpressure protection device and a refrigerant leakage detecting device are connected to the main circuit. The overpressure protection device is connected to a connection part located between the load-side
(Continued)

heat exchanger and one of the branching part and the joining part, or at the load-side heat exchanger. When leakage of refrigerant is detected, the state of a refrigerant flow switching device is set to a second state, an expansion device is set to a closed state, and a compressor is operated.

12 Claims, 6 Drawing Sheets

(51) Int. Cl.
*F24D 11/02* (2006.01)
*F24F 11/36* (2018.01)

(52) U.S. Cl.
CPC ..... *F25B 2313/003* (2013.01); *F25B 2500/07* (2013.01); *F25B 2500/221* (2013.01); *F25B 2500/222* (2013.01)

(56) References Cited

FOREIGN PATENT DOCUMENTS

| | | | |
|---|---|---|---|
| EP | 2 963 359 | A1 | 1/2016 |
| EP | 3 040 655 | A1 | 7/2016 |
| JP | 2000-104940 | A | 4/2000 |
| JP | 2001-208392 | A | 8/2001 |
| JP | 2002-061996 | A | 2/2002 |
| JP | 2011-052850 | A | 3/2011 |
| JP | 2013-137141 | A | 7/2013 |
| JP | 2013-167398 | A | 8/2013 |
| JP | 2013167395 | A | 8/2013 |
| JP | 5780977 | B2 | 9/2015 |
| JP | 2015-209979 | A | 11/2015 |
| JP | 2016-095130 | A | 5/2016 |
| JP | 2017-020776 | A | 1/2017 |
| JP | 6081033 | B1 | 2/2017 |
| WO | 2014/132378 | A1 | 9/2014 |

OTHER PUBLICATIONS

Extended European Search Report dated Apr. 21, 2020 issued in corresponding EP application No. 17912848.3.
Office Action dated Jun. 9, 2020 issued in corresponding JP application No. 2019-523324 ( and English translation).
Chinese Office Action dated Dec. 1, 2020 in Corresponding CN Patent Application No. 201780091556.8, (and English Machine Translation).
Chinese Office Action dated Apr. 6, 2021, issued in corresponding Chinese Patent Application No. 201780091556.8 (and English Machine Translation).

* cited by examiner

APPARATUS USING A HEAT PUMP INCLUDING A REFRIGERANT LEAKAGE DETECTOR

CROSS REFERENCE TO RELATED APPLICATION

This application is a U.S. national stage application of PCT/JP2017/021507 filed on Jun. 9, 2017, the contents of which are incorporated herein by reference.

TECHNICAL FIELD

The present invention relates to an apparatus using a heat pump and having a refrigerant circuit and a heat medium circuit.

BACKGROUND ART

Patent Literature 1 describes an outdoor unit of a heat pump cycle device using a flammable refrigerant. The outdoor unit includes a refrigerant circuit in which a compressor, an air-heat exchanger, an expansion device, and a water-heat exchanger are connected by pipes, and a pressure relief valve that prevents an excessive increase in hydraulic pressure in a water circuit that supplies water heated by the water-heat exchanger. Thereby, even when a partition wall that isolates the refrigerant circuit and the water circuit from each other in the water-heat exchanger is broken and the flammable refrigerant thus enters the water circuit, the flammable refrigerant can be discharged to the outdoors via the pressure relief valve.

CITATION LIST

Patent Literature

Patent Literature 1: Japanese Unexamined Patent Application Publication No. 2013-167398

SUMMARY OF INVENTION

Technical Problem

In an apparatus using a heat pump, such as a heat pump cycle device, a pressure relief valve of a water circuit is typically installed in an indoor unit. In the apparatuses using heat pumps, there are various combinations of outdoor and indoor units, such as not only a combination of an outdoor unit and an indoor unit manufactured by the same manufacturer but also a combination of an outdoor unit and an indoor unit manufactured by different manufacturers. Consequently, the outdoor unit described in Patent Literature 1 may be used with an indoor unit equipped with a pressure relief valve.

However, in such a case, when refrigerant leaks into the water circuit, the refrigerant mixed with water in the water circuit may be discharged not only from a pressure relief valve installed in the outdoor unit but also from a pressure relief valve installed in the indoor unit. Thus, there is a risk that the refrigerant will leak into an indoor space via the water circuit.

The present invention aims to provide an apparatus using a heat pump that can prevent leakage of refrigerant into an indoor space.

Solution to Problem

An apparatus using a heat pump according to an embodiment of the present invention includes a refrigerant circuit that includes a compressor, a refrigerant flow switching device, a heat-source-side heat exchanger, an expansion device, and a load-side heat exchanger, and is configured to circulate refrigerant, and a heat medium circuit configured to cause a heat medium to flow via the load-side heat exchanger. The refrigerant flow switching device is configured in such a manner that a state of the refrigerant flow switching device is switchable between a first state and a second state. The refrigerant circuit is allowed to perform a first operation in which the load-side heat exchanger is used as a condenser, when the state of the refrigerant flow switching device is switched to the first state. The refrigerant circuit is allowed to perform a second operation in which the load-side heat exchanger is used as an evaporator, when the state of the refrigerant flow switching device is switched to the second state. The heat medium circuit includes a main circuit extending via the load-side heat exchanger. The main circuit includes a branching part provided at a downstream end of the main circuit, the branching part being a part at which a plurality of branch circuits that branch off from the main circuit are connected, and a joining part provided at an upstream end of the main circuit, the joining part being a part at which the plurality of branch circuits are connected to join the main circuit. To the main circuit, an overpressure protection device and a refrigerant leakage detecting device are connected. In the main circuit, the overpressure protection device is connected to a connection part that is located between the load-side heat exchanger and one of the branching part and the joining part, or at the load-side heat exchanger. In the main circuit, the refrigerant leakage detecting device is connected to the other of the branching part and the joining part, between the connection part and the other of the branching part and the joining part, or at the connection part. When leakage of the refrigerant into the heat medium circuit is detected, the refrigerant flow switching device is set to the second state, the expansion device is set to a closed state, and the compressor is made in operation.

Advantageous Effects of Invention

According to an embodiment of the present invention, in a case where refrigerant leaks into the heat medium circuit, the refrigerant leakage detecting device can early detect the leakage of the refrigerant into the heat medium circuit. When the leakage of the refrigerant into the heat medium circuit is detected, the refrigerant in the refrigerant circuit is retrieved. As the leakage of the refrigerant is earlier detected, the refrigerant is also earlier retrieved. Consequently, leakage of the refrigerant into an indoor space can be prevented.

Figure 6:
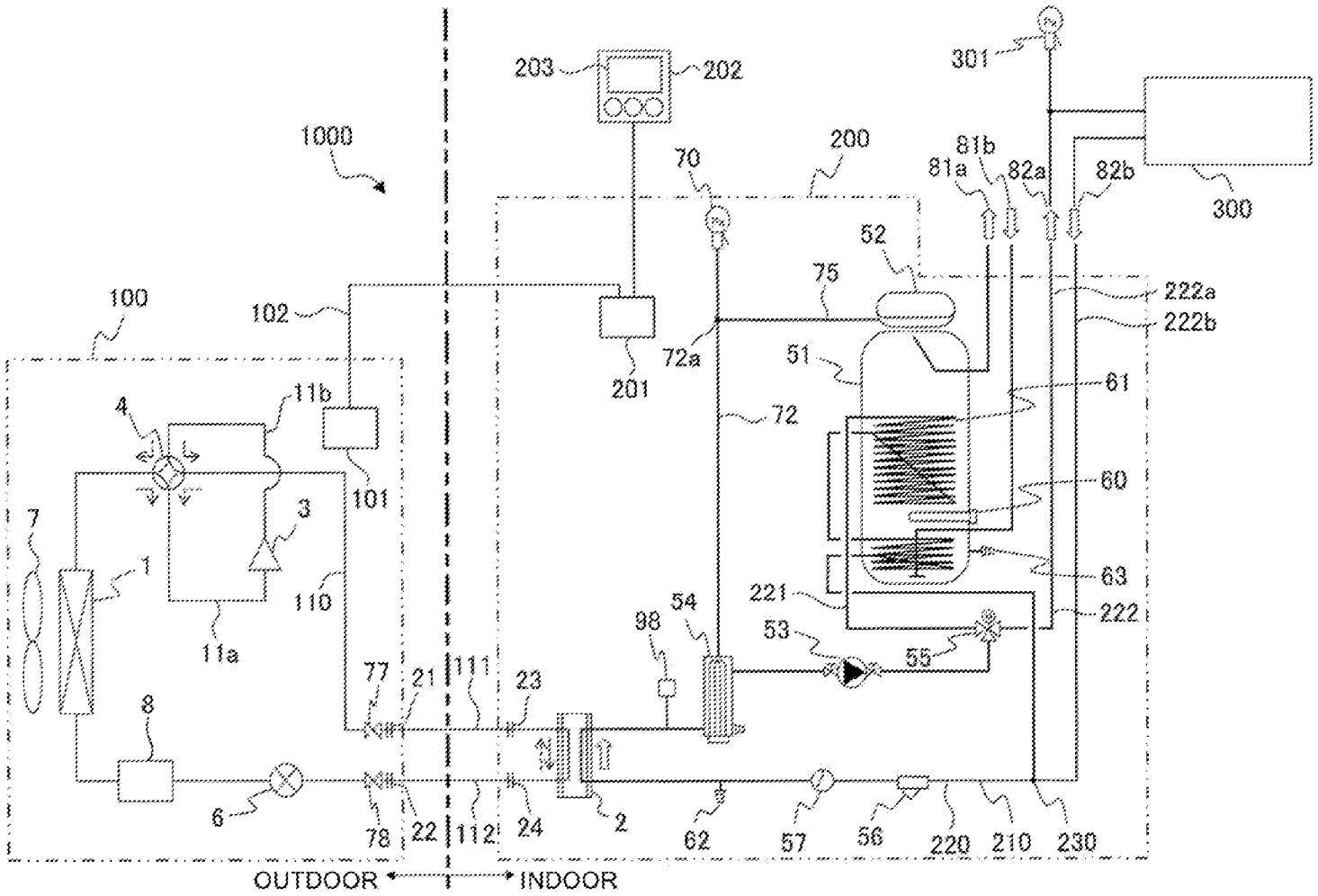

FIG. 6 is a circuit diagram illustrating a schematic configuration of an apparatus using a heat pump according to Embodiment 2 of the present invention.

Figure 7:
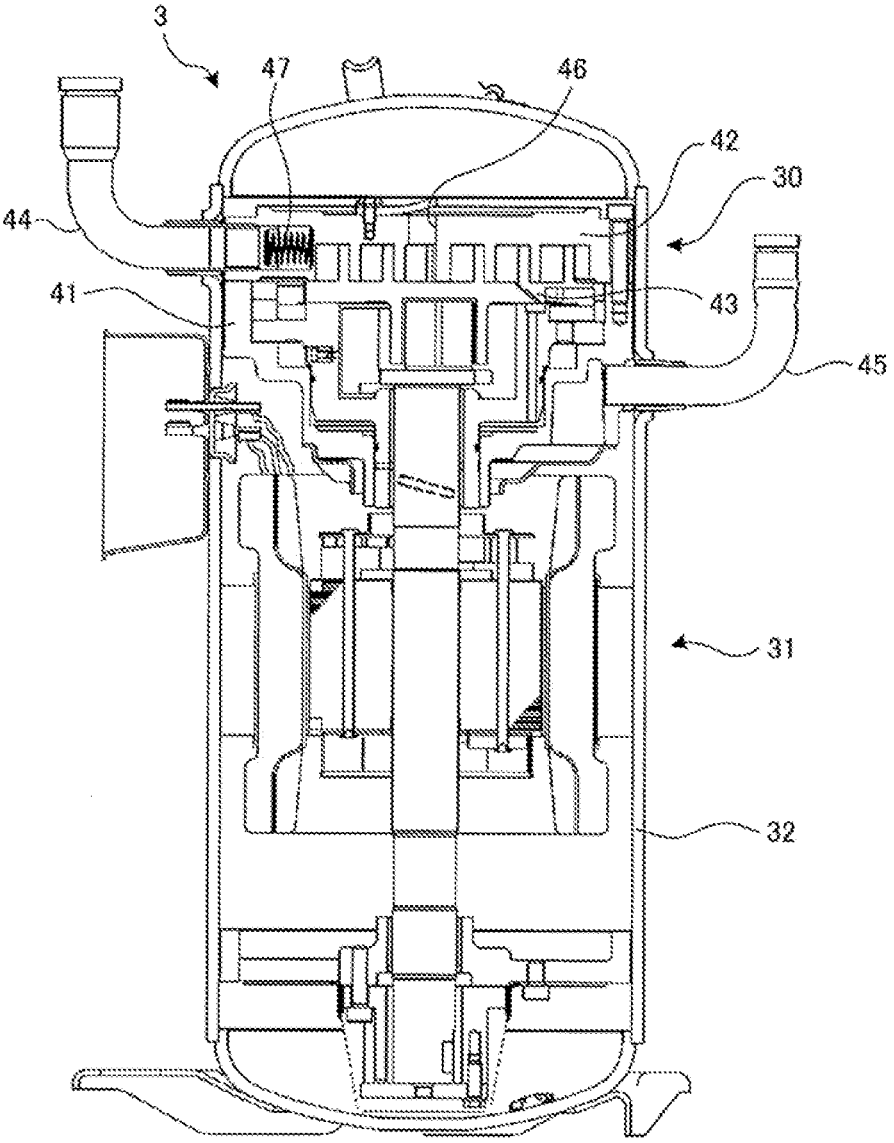

FIG. 7 is a sectional view illustrating a schematic configuration of a compressor 3 of the apparatus using a heat pump according to Embodiment 2 of the present invention.

DESCRIPTION OF EMBODIMENTS

Embodiment 1

Figure 1:
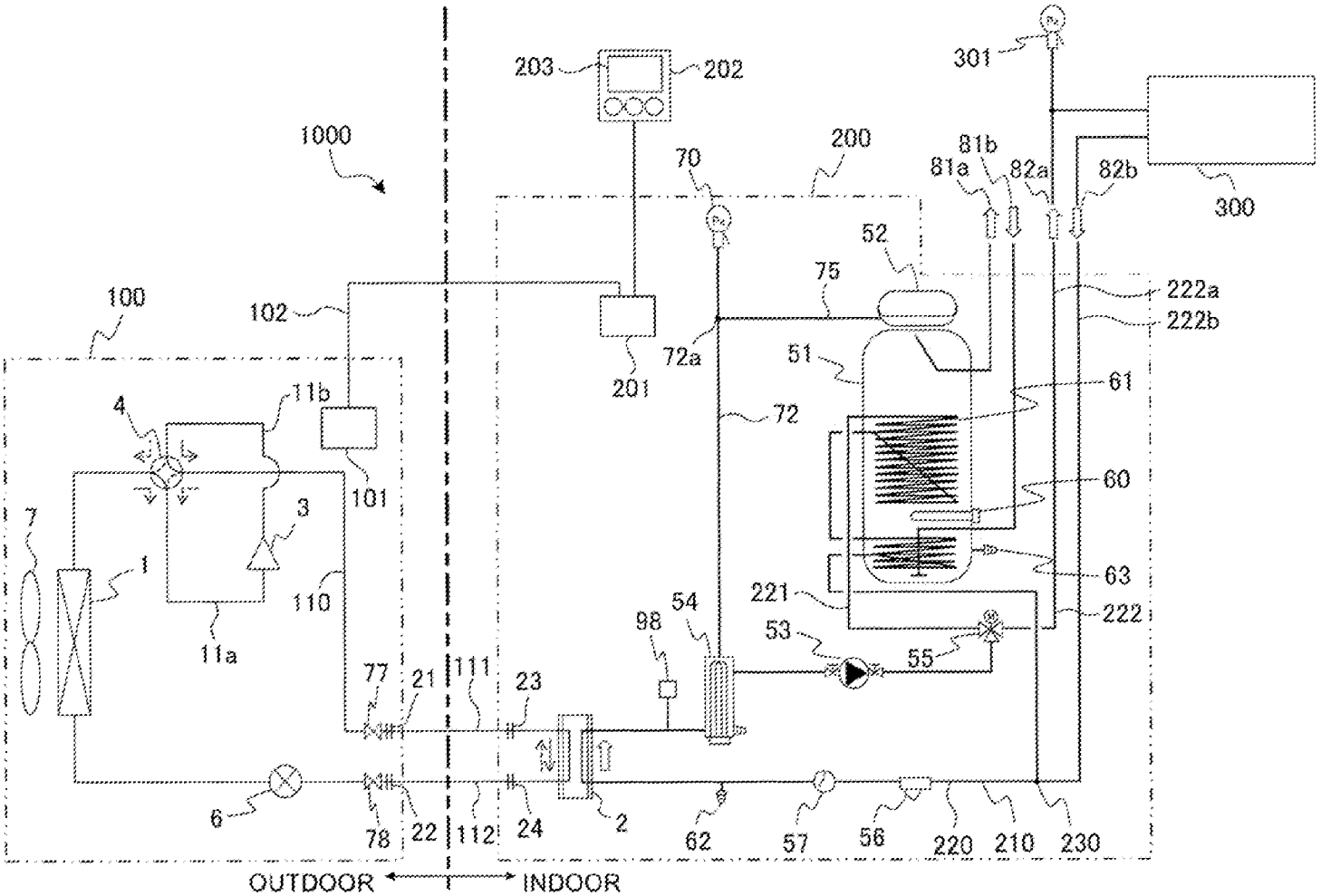
FIG. 1 is a circuit diagram illustrating a schematic configuration of an apparatus using a heat pump according to Embodiment 1 of the present invention.

An apparatus using a heat pump according to Embodiment 1 of the present invention will be described. FIG. 1 is a circuit diagram illustrating a schematic configuration of the apparatus using a heat pump according to Embodiment 1. In Embodiment 1, a heat pump hot-water supply heating apparatus 1000 is provided as an example of the apparatus using a heat pump. Note that, in the drawings including FIG. 1, the relationships in size among structural components and the shapes and other properties of the structural components may be different from actual ones.

As illustrated in FIG. 1, the heat pump hot-water supply heating apparatus 1000 includes a refrigerant circuit 110 in which refrigerant is circulated and a water circuit 210 through which water flows. The heat pump hot-water supply heating apparatus 1000 further includes an outdoor unit 100 installed outside an indoor space (e.g., outdoors) and an indoor unit 200 installed in the indoor space. The indoor unit 200 is installed in, for example, a kitchen, a bathroom, a laundry room, or a storage space such as a closet in a building.

The refrigerant circuit 110 has a configuration in which a compressor 3, a refrigerant flow switching device 4, a load-side heat exchanger 2, an expansion device 6, and a heat-source-side heat exchanger 1 are successively connected in a loop by refrigerant pipes. The refrigerant circuit 110 of the heat pump hot-water supply heating apparatus 1000 is capable of performing a heating and hot-water supplying operation to heat water flowing in the water circuit 210 (which will be hereinafter occasionally referred to as "normal operation" or "first operation"), and a defrosting operation to defrost the heat-source-side heat exchanger 1 by making the refrigerant flow in the opposite direction to the flow of the refrigerant in the heating and hot-water supplying operation (which will be hereinafter occasionally referred to as "second operation"). The refrigerant circuit 110 may also be capable of performing a cooling operation to cool the water flowing in the water circuit 210. In the cooling operation, the refrigerant flows in the same direction as in the defrosting operation.

The compressor 3 is a fluidic machine that sucks and compresses refrigerant in a low-pressure state, and discharges the refrigerant in a high-pressure state. The compressor 3 of Embodiment 1 includes, for example, an inverter device that arbitrarily changes a driving frequency.

Figure 2:
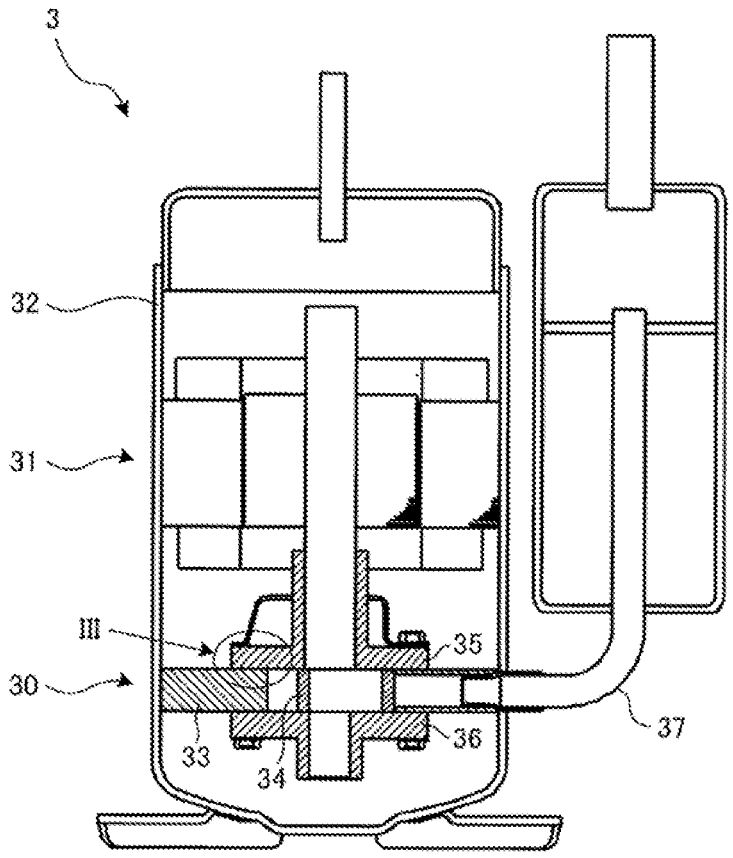
FIG. 2 is a sectional view illustrating a schematic configuration of a compressor 3 of the apparatus using a heat pump according to Embodiment 1 of the present invention.
Figure 3:
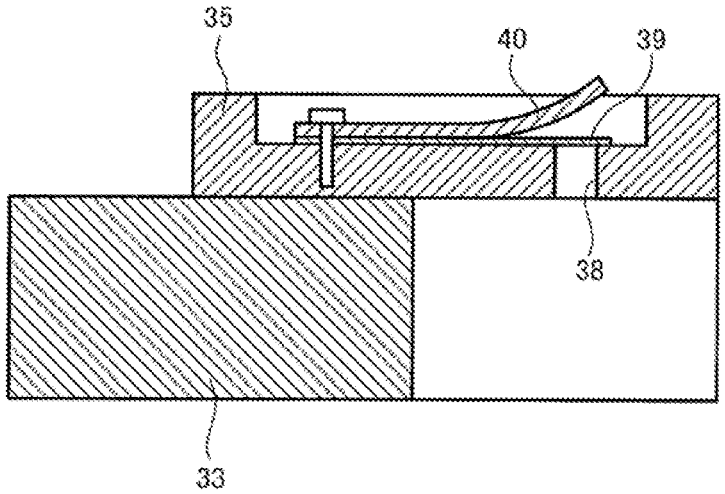
FIG. 3 is an enlarged view of a section III of FIG. 2.

An example of a configuration of the compressor 3 will be described below with reference to the drawings. FIG. 2 is a sectional view illustrating a schematic configuration of the compressor 3 of the apparatus using a heat pump according to Embodiment 1. FIG. 3 is an enlarged view of a section III of FIG. 2. FIGS. 2 and 3 illustrate a sealed and high-pressure shell rolling piston rotary compressor as the compressor 3. As illustrated in FIGS. 2 and 3, the compressor 3 includes a compression mechanism unit 30 that sucks and compresses refrigerant, and an electric motor unit 31 that drives the compression mechanism unit 30, and a sealed container 32 that houses the compression mechanism unit 30 and the electric motor unit 31. The compression mechanism unit 30 is provided at a lower portion in the sealed container 32. The electric motor unit 31 is provided above the compression mechanism unit 30 in the sealed container 32. The inner space of the sealed container 32 is filled with the refrigerant in a high-pressure state compressed by the compression mechanism unit 30.

The compression mechanism unit 30 includes a cylinder 33, a rolling piston 34 that is provided in the cylinder 33 and to which a rotational driving force of the electric motor unit 31 is transmitted via a main shaft, and vanes (not shown) that each partition the corresponding space between an inner circumferential surface of the cylinder 33 and an outer circumferential surface of the rolling piston 34 into a suction chamber and a compression chamber. Upper ends of the suction chamber and the compression chamber are closed by an upper end plate 35 that is also used as a bearing. Lower ends of the suction chamber and the compression chamber are closed by a lower end plate 36 that is also used as a bearing. Refrigerant in a low-pressure state is sucked into the suction chamber via a suction pipe 37. The upper end plate 35 has a discharge hole 38 through which the refrigerant in a high-pressure state compressed in the compression chamber is discharged into a space in the sealed container 32. At an outlet end of the discharge hole 38, there are provided a discharge valve 39 having a reed valve structure and a valve stopper 40 that restricts flexure of the discharge valve 39. The discharge valve 39 is used as a check valve that prevents the high-pressure refrigerant in the sealed container 32 from flowing back to the compression chamber during a compression process. The discharge valve 39 also is used as a check valve when the compressor 3 is in a stopped state.

With reference back to FIG. 1, the refrigerant flow switching device 4 is configured to switch the flow directions of the refrigerant in the refrigerant circuit 110 between that in the normal operation and that in the defrosting operation. As the refrigerant flow switching device 4, a four-way valve or a combination of a plurality of two-way valves or three-way valves may be used. The refrigerant flow switching device 4 and the compressor 3 are connected by a suction pipe 11*a* and a discharge pipe 11*b*. The suction pipe 11*a* connects the refrigerant flow switching device 4 and a suction port of the compressor 3. In the suction pipe 11*a*, refrigerant in a low-pressure state flows from the refrigerant flow switching device 4 toward the compressor 3 regardless of the state of the refrigerant flow switching device 4. The discharge pipe 11*b* connects the refrigerant flow switching device 4 and a discharge port of the compressor 3. In the discharge pipe 11*b*, the refrigerant in a high-pressure state flows from the compressor 3 toward the refrigerant flow switching device 4 regardless of the state of the refrigerant flow switching device 4. Note that, in the case where the refrigerant circuit 110 is dedicated to the heating operation or the cooling operation, the refrigerant flow switching device 4 can be omitted.

The load-side heat exchanger 2 is a water-refrigerant heat exchanger in which heat is exchanged between refrigerant flowing in the refrigerant circuit 110 and water flowing in the water circuit 210. As the load-side heat exchanger 2, for example, a plate heat exchanger is used. The load-side heat exchanger 2 includes a refrigerant passage that allows refrigerant to flow through the refrigerant passage as part of the refrigerant circuit 110, a water passage that allows water to flow through the water passage as part of the water circuit 210, and a thin-plate partition wall that isolates the refrigerant passage and the water passage from each other. In the normal operation, the load-side heat exchanger 2 is used as a condenser that heats water, that is, a radiator. In the defrosting operation or the cooling operation, the load-side heat exchanger 2 is used as an evaporator, that is, a heat absorber.

The expansion device 6 is configured to adjust the flow rate of the refrigerant to adjust, for example, the pressure of the refrigerant flowing in the load-side heat exchanger 2. The expansion device 6 of Embodiment 1 is an electronic expansion valve, the opening degree of which can be changed in accordance with an instruction from a controller 101, which will be described later. As the expansion device 6, a temperature-sensitive expansion valve, such as a temperature-sensitive expansion valve integrated with a solenoid valve, may be used.

The heat-source-side heat exchanger 1 is an air-refrigerant heat exchanger in which heat is exchanged between the refrigerant flowing in the refrigerant circuit 110 and outdoor air sent by an outdoor fan 7. The heat-source-side heat exchanger 1 is used as an evaporator in the normal operation, and is used as a condenser in the defrosting operation.

The compressor 3, the refrigerant flow switching device 4, the expansion device 6, and the heat-source-side heat exchanger 1 are housed in the outdoor unit 100. The load-side heat exchanger 2 is housed in the indoor unit 200. That is, the refrigerant circuit 110 is provided to extend over the outdoor unit 100 and the indoor unit 200. Part of the refrigerant circuit 110 is provided in the outdoor unit 100, and another part of the refrigerant circuit 110 is provided in the indoor unit 200. The outdoor unit 100 and the indoor unit 200 are connected by two extension pipes 111 and 112 each forming part of the refrigerant circuit 110. One end of the extension pipe 111 is connected to the outdoor unit 100 via a joint unit 21. The other end of the extension pipe 111 is connected to the indoor unit 200 via a joint unit 23. One end of the extension pipe 112 is connected to the outdoor unit 100 via a joint unit 22. The other end of the extension pipe 112 is connected to the indoor unit 200 via a joint unit 24. As each of the joint units 21, 22, 23, and 24, for example, a flare joint is used.

As a first blocking device, an opening and closing valve 77 is provided upstream of the load-side heat exchanger 2 in the flow of the refrigerant in the normal operation. In the flow of the refrigerant in the normal operation, the opening and closing valve 77 is provided downstream of the heat-source-side heat exchanger 1 and upstream of the load-side heat exchanger 2 in the refrigerant circuit 110. That is, in the refrigerant circuit 110, the opening and closing valve 77 is located between the load-side heat exchanger 2 and the refrigerant flow switching device 4, at the suction pipe 11*a*, which is located between the refrigerant flow switching device 4 and the compressor 3, at the discharge pipe 11*b*, which is located between the refrigerant flow switching device 4 and the compressor 3, between the refrigerant flow switching device 4 and the heat-source-side heat exchanger 1, or at the compressor 3. In the case where the refrigerant flow switching device 4 is provided as in Embodiment 1, it is preferable that the opening and closing valve 77 be provided downstream of the refrigerant flow switching device 4 and upstream of the load-side heat exchanger 2 in the refrigerant circuit 110 in the flow of the refrigerant in the normal operation. The opening and closing valve 77 is housed in the outdoor unit 100. As the opening and closing valve 77, an automatic valve, such as a solenoid valve, a flow control valve, and an electronic expansion valve, that is controlled by the controller 101, which will be described later, is used. The opening and closing valve 77 is in an opened state during the operation of the refrigerant circuit 110, which includes the normal operation and the defrosting operation. When the opening and closing valve 77 is set to a closed state by the control of the controller 101, the opening and closing valve 77 blocks the flow of the refrigerant.

Further, as a second blocking device, an opening and closing valve 78 is provided downstream of the load-side heat exchanger 2 in the flow of the refrigerant in the normal operation. In the flow of the refrigerant in the normal operation, the opening and closing valve 78 is provided downstream of the load-side heat exchanger 2 and upstream of the heat-source-side heat exchanger 1 in the refrigerant circuit 110. The opening and closing valve 78 is housed in the outdoor unit 100. As the opening and closing valve 78, an automatic valve, such as a solenoid valve, a flow control valve, and an electronic expansion valve, that is controlled by the controller 101, which will be described later, is used. The opening and closing valve 78 is in an opened state during the operation of the refrigerant circuit 110, which includes the normal operation and the defrosting operation. When the opening and closing valve 78 is set to a closed state by the control of the controller 101, the opening and closing valve 78 blocks the flow of the refrigerant.

The opening and closing valves 77 and 78 may be manual valves to be opened and closed manually. There is a case where, at a connecting part between the outdoor unit 100 and the extension pipe 111, an extension pipe connecting valve is provided that has a two-way valve capable of manually switching an opened state and a closed state. One end of the extension pipe connecting valve is connected to a refrigerant pipe in the outdoor unit 100, and the other end of the extension pipe connecting valve is provided with the joint unit 21. In the case where such an extension pipe connecting valve is provided, the extension pipe connecting valve may be used as the opening and closing valve 77.

Also, there is a case where, at a connecting part between the outdoor unit 100 and the extension pipe 112, an extension pipe connecting valve is provided that has a three-way valve capable of manually switching an opened state and a closed state. One end of the extension pipe connecting valve is connected to a refrigerant pipe in the outdoor unit 100, and another end of the extension pipe connecting valve is provided with the joint unit 22. The remaining end of the extension pipe connecting valve is provided with a service port that is used to perform vacuuming before the refrigerant circuit 110 is filled with refrigerant. In the case where such an extension pipe connecting part is provided, the extension pipe connecting valve may be used as the opening and closing valve 78.

As the refrigerant circulating in the refrigerant circuit 110, for example, a slightly flammable refrigerant such as R1234yf and R1234ze(E), or a highly flammable refrigerant such as R290 and R1270 is used. Each of these refrigerants may be used as a single-component refrigerant, or two or more of these refrigerants may be mixed and used as a mixed refrigerant. Hereinafter, there is a case where a refrigerant having flammability of at least a slightly flammable level (2L or higher under ASHRAE 34 classification, for example) is referred to as "flammable refrigerant". Further, as the refrigerant circulating in the refrigerant circuit 110, an inflammable refrigerant having inflammability (1 under ASHRAE 34 classification, for example) such as R4070 and R410A may be also used. These refrigerants each have a higher density than does air under atmospheric pressure (when the temperature is room temperature (25 degrees Celsius), for example). Furthermore, as the refrigerant circulating in the refrigerant circuit 110, a refrigerant having toxicity, such as R717 (ammonia) may be also used.

In addition, the outdoor unit 100 is provided with a controller 101 that controls mainly the operation of the refrigerant circuit 110 including the compressor 3, the refrigerant flow switching device 4, the opening and closing valves 77 and 78, the expansion device 6, the outdoor fan 7, and other devices. The controller 101 includes a microcomputer provided with a CPU, a ROM, a RAM, an input-output port, and other components. The controller 101 is capable of communicating, via a control line 102, with a controller 201 and an operation unit 202, which are described later.

Next, an example of the operation of the refrigerant circuit 110 will be described. In FIG. 1, solid arrows represent the flow direction of refrigerant in the refrigerant circuit 110 in the normal operation. In the normal operation, the refrigerant flow switching device 4 switches refrigerant passages as represented by the solid arrows, and the refrigerant circuit 110 is configured in such a manner that refrigerant in a high-temperature and high-pressure state flows into the load-side heat exchanger 2. There is a case where the state of the refrigerant flow switching device 4 in the normal operation will be referred to as a first state.

The refrigerant in a high-temperature and high-pressure gaseous state discharged from the compressor 3 passes through the refrigerant flow switching device 4, the opening and closing valve 77 in an opened state, and the extension pipe 111, and flows into the refrigerant passage of the load-side heat exchanger 2. In the normal operation, the load-side heat exchanger 2 is used as a condenser. That is, in the load-side heat exchanger 2, heat is exchanged between refrigerant flowing in the refrigerant passage and water flowing in the water passage, and the condensation heat of the refrigerant is transferred to the water. Thereby, the refrigerant flowing in the refrigerant passage of the load-side heat exchanger 2 condenses and changes into the refrigerant in a high-pressure liquefied state. Furthermore, the water flowing in the water passage of the load-side heat exchanger 2 is heated by the heat transferred from the refrigerant.

The high-pressure liquid refrigerant condensed at the load-side heat exchanger 2 flows into the expansion device 6 via the extension pipe 112 and the opening and closing valve 78 in an opened state, and is reduced in pressure to change into refrigerant in a low-pressure two-phase state. The low-pressure two-phase refrigerant flows into the heat-source-side heat exchanger 1. In the normal operation, the heat-source-side heat exchanger 1 is used as an evaporator. That is, heat is exchanged between refrigerant flowing in the heat-source-side heat exchanger 1 and outdoor air sent by the outdoor fan 7, and the evaporation heat of the refrigerant is received from the outdoor air. Thereby, the refrigerant flowing into the heat-source-side heat exchanger 1 evaporates and changes into refrigerant in a low-pressure gaseous state. The low-pressure gas refrigerant is sucked into the compressor 3 via the refrigerant flow switching device 4. The refrigerant sucked into the compressor 3 is compressed and changes into refrigerant in a high-temperature and high-pressure gaseous state. In the normal operation, the above cycle is continuously repeated.

Next, an example of the operation during the defrosting operation will be described. In FIG. 1, broken arrows represent the flow direction of the refrigerant in the refrigerant circuit 110 in the defrosting operation. In the defrosting operation, the refrigerant flow switching device 4 switches the refrigerant passages as represented by the broken arrows, and the refrigerant circuit 110 is configured in such a manner that refrigerant in a high-temperature and high-pressure state flows into the heat-source-side heat exchanger 1. There is a case where the state of the refrigerant flow switching device 4 in the defrosting operation will be referred to as a second state.

The refrigerant in a high-temperature and high-pressure gaseous state discharged from the compressor 3 flows into the heat-source-side heat exchanger 1 via the refrigerant flow switching device 4. In the defrosting operation, the heat-source-side heat exchanger 1 is used as a condenser. That is, the condensation heat of the refrigerant flowing in the heat-source-side heat exchanger 1 is transferred to frost formed on a surface of the heat-source-side heat exchanger 1. Thereby, the refrigerant flowing in the heat-source-side heat exchanger 1 condenses and changes into refrigerant in a high-pressure liquefied state. Further, the frost formed on the surface of the heat-source-side heat exchanger 1 is melt by the heat transferred from the refrigerant.

The high-pressure liquid refrigerant condensed at the heat-source-side heat exchanger 1 passes through the expansion device 6 to change into refrigerant in a low-pressure two-phase state, and then flows into the refrigerant passage of the load-side heat exchanger 2 via the opening and closing valve 78 in an opened state and the extension pipe 112. In the defrosting operation, the load-side heat exchanger 2 is used as an evaporator. That is, in the load-side heat exchanger 2, heat is exchanged between refrigerant flowing in the refrigerant passage and water flowing in the water passage, and the evaporation heat of the refrigerant is received from the water. Thereby, the refrigerant flowing in the refrigerant passage of the load-side heat exchanger 2 evaporates and changes into refrigerant in a low-pressure gaseous state. The low-pressure gas refrigerant is sucked into the compressor 3 via the extension pipe 111, the opening and closing valve 77 in an opened state, and the refrigerant flow switching device 4. The refrigerant sucked into the compressor 3 is compressed and changes into refrigerant in a high-temperature and high-pressure gaseous state. In the defrosting operation, the above cycle is continuously repeated.

Next, the water circuit 210 will be described. The water circuit 210 of Embodiment 1 is a closed circuit that circulates water. In FIG. 1, the flow directions of the water are represented by outlined thick arrows. The water circuit 210 is housed mainly in the indoor unit 200. The water circuit 210 includes a main circuit 220, a branch circuit 221 forming a hot-water supply circuit, and a branch circuit 222 forming part of a heating circuit. The main circuit 220 forms part of the closed circuit. The branch circuits 221 and 222 are connected to the main circuit 220 and branch off from the main circuit 220. The branch circuits 221 and 222 are disposed in parallel to each other. The branch circuit 221 forms, together with the main circuit 220, the closed circuit. The branch circuit 222 forms, together with the main circuit 220 and a heating apparatus 300 or another apparatus that is connected to the branch circuit 222, the closed circuit. The heating apparatus 300 is provided in the indoor space, and is located separately from the indoor unit 200. As the heating apparatus 300, for example, a radiator or a floor-heating apparatus is used.

In Embodiment 1, although water is described as an example of a heat medium that flows in the water circuit 210, another liquid heat medium such as brine can be used as the heat medium.

The main circuit 220 has a configuration in which a strainer 56, a flow switch 57, the load-side heat exchanger 2, a booster heater 54, a pump 53, and other devices are connected by water pipes. At a point in the water pipes forming the main circuit 220, a drain outlet 62 is provided to drain water in the water circuit 210. A downstream end of the main circuit 220 is connected to an inflow port of a three-way valve 55 (an example of a branching part) including the single inflow port and two outflow ports. At the three-way valve 55, the branch circuits 221 and 222 branch off from the main circuit 220. An upstream end of the main circuit 220 is connected to a joining part 230. At the joining part 230, the branch circuits 221 and 222 join the main circuit 220. Part of the water circuit 210 that extends from the joining part 230 to the three-way valve 55 via the load-side heat exchanger 2 and other devices forms the main circuit 220.

The pump 53 is a device that pressurizes the water in the water circuit 210 to circulate the water in the water circuit 210. The booster heater 54 is a device that further heats the water in the water circuit 210 when, for example, the heating capacity of the outdoor unit 100 is insufficient. The three-way valve 55 is a device that changes the flow of the water in the water circuit 210. For example, the three-way valve 55 switches the flow of the water in the main circuit 220 between circulation of the water in the branch circuit 221 and circulation of the water in the branch circuit 222. The strainer 56 is a device that removes scale in the water circuit 210. The flow switch 57 is a device that detects whether or not the flow rate of the water circulating in the water circuit 210 is higher than or equal to a certain rate. The flow switch 57 can be replaced by a flow rate sensor.

The booster heater 54 is connected to a pressure relief valve 70 (an example of an overpressure protection device). That is, the booster heater 54 is used as a connection part of the pressure relief valve 70 for the water circuit 210. There is a case where the connection part of the pressure relief valve 70 for the water circuit 210 is hereinafter merely referred to as "connection part". The pressure relief valve 70 is a protection device that prevents an excessive increase in pressure in the water circuit 210 due to a change in temperature of the water. The pressure relief valve 70 discharges the water to the outside of the water circuit 210 depending on the pressure in the water circuit 210. For example, when the inner pressure of the water circuit 210 increases to exceed a pressure control range of an expansion tank 52 (which will be described later), the pressure relief valve 70 is opened and the water in the water circuit 210 is discharged to the outside of the water circuit 210 from the pressure relief valve 70. The pressure relief valve 70 is provided at the indoor unit 200 for pressure protection of the water circuit 210 in the indoor unit 200.

A housing of the booster heater 54 is connected to one end of a pipe 72 forming a water passage branching off from the main circuit 220. The other end of the pipe 72 is provided with the pressure relief valve 70. That is, the pressure relief valve 70 is connected to the booster heater 54 via the pipe 72. In the main circuit 220, the temperature of water is the highest in the booster heater 54. Consequently, the booster heater 54 is the most suitable as the connection part to which the pressure relief valve 70 is connected. Further, in a case where the pressure relief valve 70 is connected to the branch circuits 221 and 222, respective pressure relief valves 70 need to be provided to the branch circuits 221 and 222. However, in Embodiment 1, as the pressure relief valve 70 is connected to the main circuit 220, only the single pressure relief valve 70 is needed. When the pressure relief valve 70 is connected to the main circuit 220, the connection part of the pressure relief valve 70 is located between the load-side heat exchanger 2 and one of the three-way valve 55 and the joining part 230 or at the load-side heat exchanger 2 in the main circuit 220.

At a point in the pipe 72, a branching part 72*a* is provided. The branching part 72*a* is connected to one end of a pipe 75. The other end of the pipe 75 is connected to the expansion tank 52. That is, the expansion tank 52 is connected to the booster heater 54 via the pipes 75 and 72. The expansion tank 52 is a device that controls the change of the inner pressure of the water circuit 210 due to a change in the temperature of the water in such a manner that the change of the inner pressure of the water circuit 210 falls within a certain range.

The main circuit 220 is provided with a refrigerant leakage detecting device 98. The refrigerant leakage detecting device 98 is connected between the load-side heat exchanger 2 and the booster heater 54 (that is, the connection part) in the main circuit 220. The refrigerant leakage detecting device 98 is a device that detects leakage of refrigerant from the refrigerant circuit 110 into the water circuit 210. When refrigerant leaks from the refrigerant circuit 110 into the water circuit 210, the inner pressure of the water circuit 210 increases. Consequently, the refrigerant leakage detecting device 98 can detect the leakage of the refrigerant into the water circuit 210 on the basis of the value of the inner pressure of the water circuit 210 or the change of the inner pressure of the water circuit 210 with time. As the refrigerant leakage detecting device 98, a pressure sensor or a pressure switch (high-pressure switch in Embodiment 1) that detects the inner pressure of the water circuit 210 is used. The pressure switch may be, for example, an electric pressure switch or a mechanical pressure switch using a diaphragm. The refrigerant leakage detecting device 98 outputs detection signals to the controller 201.

The branch circuit 221 forming the hot-water supply circuit is provided in the indoor unit 200. An upstream end of the branch circuit 221 is connected to one of the outflow ports of the three-way valve 55. A downstream end of the branch circuit 221 is connected to the joining part 230. The branch circuit 221 includes a coil 61. The coil 61 is accommodated in a hot-water storage tank 51 that stores water. The coil 61 is a heating unit that heats the water stored in the hot-water storage tank 51 through heat exchange with hot water circulating in the branch circuit 221 of the water circuit 210. Furthermore, the hot-water storage tank 51 accommodates an immersion heater 60. The immersion heater 60 is a heating unit that further heats the water stored in the hot-water storage tank 51.

An upper part in the hot-water storage tank 51 is connected to a sanitary circuit-side pipe 81*a* (for example, a hot-water supply pipe) that is connected to a shower, for example. A lower part in the hot-water storage tank 51 is connected to a sanitary circuit-side pipe 81*b* (for example, a supply water pipe). A lower part of the hot-water storage tank 51 is provided with a drain outlet 63 to drain the water in the hot-water storage tank 51. The hot-water storage tank 51 is covered by a heat insulating material (not shown) to prevent reduction of the temperature of the water in the hot-water storage tank 51 due to transfer of heat to the outside of the hot-water storage tank 51. As the heat insulating material, for example, felt, Thinsulate (registered trademark), Vacuum Insulation Panel (VIP), or another material is used.

The branch circuit 222 forming part of the heating circuit is provided in the indoor unit 200. The branch circuit 222 includes a supply pipe 222*a* and a return pipe 222*b*. An upstream end of the supply pipe 222*a* is connected to the other one of the outflow ports of the three-way valve 55. A downstream end of the supply pipe 222*a* and an upstream end of the return pipe 222*b* are connected to heating circuit-side pipes 82*a* and 82*b*, respectively. A downstream end of the return pipe 222*b* is connected to the joining part 230. Thereby, the supply pipe 222*a* and the return pipe 222*b* are connected to the heating apparatus 300 via the heating circuit-side pipes 82*a* and 82*b*, respectively. The heating circuit-side pipes 82*a* and 82*b* and the heating apparatus 300 are disposed in the indoor space but outside the indoor unit 200. The branch circuit 222 forms, together with the heating circuit-side pipes 82*a* and 82*b* and the heating apparatus 300, the heating circuit.

The heating circuit-side pipe 82*a* is connected to a pressure relief valve 301. The pressure relief valve 301 is a protection device that prevents an excessive increase in the inner pressure of the water circuit 210, and has the same structure as the pressure relief valve 70, for example. When the inner pressure of the heating circuit-side pipe 82*a* exceeds a set pressure, the pressure relief valve 301 is opened to discharge water in the heating circuit-side pipe 82*a* to the outside of the heating circuit-side pipe 82*a* from the pressure relief valve 301. The pressure relief valve 301 is provided in the indoor space but outside the indoor unit 200.

The heating apparatus 300, the heating circuit-side pipes 82*a* and 82*b*, and the pressure relief valve 301 of Embodiment 1 are not part of the heat pump hot-water supply heating apparatus 1000, but are devices to be installed by a technician in the actual place depending on the circumstances of each of properties. In existing devices using a boiler as a heat source apparatus of the heating apparatus 300, there is a case where the heat source apparatus is replaced with the heat pump hot-water supply heating apparatus 1000. In such a case, the heating apparatus 300, heating circuit-side pipes 82*a* and 82*b*, and the pressure relief valve 301 are used as they are, unless they cause any particular inconvenience. Consequently, it is preferable that the heat pump hot-water supply heating apparatus 1000 be connectable to various kinds of devices regardless of presence and absence of the pressure relief valve 301.

The indoor unit 200 is provided with the controller 201 that controls mainly the operation of the water circuit 210 including the pump 53, the booster heater 54, the three-way valve 55, and other devices. The controller 201 includes a microcomputer provided with a CPU, a ROM, a RAM, an input-output port, and other components. The controller 201 is capable of mutually communicating with the controller 101 and the operation unit 202.

The operation unit 202 is configured to allow a user to operate the heat pump hot-water supply heating apparatus 1000, and to make various settings. In Embodiment 1, the operation unit 202 includes a display 203 as a notifying unit that notifies information. The display 203 can display various information such as the state of the heat pump hot-water supply heating apparatus 1000. The operation unit 202 is attached to, for example, a surface of a housing of the indoor unit 200.

Next, operations in a case where a partition wall isolating the refrigerant passage and the water passage from each other is broken in the load-side heat exchanger 2 will be described. The load-side heat exchanger 2 is used as an evaporator in the defrosting operation. Consequently, the partition wall of the load-side heat exchanger 2 may be broken by, for example, freezing of water, which occurs particularly in the defrosting operation. The pressure of refrigerant flowing in the refrigerant passage of the load-side heat exchanger 2 is typically higher than the pressure of water flowing in the water passage of the load-side heat exchanger 2 in either the normal operation or the defrosting operation. Consequently, when the partition wall of the load-side heat exchanger 2 is broken, the refrigerant in the refrigerant passage flows out into the water passage and mixes with the water in the water passage in either the normal operation or the defrosting operation. At this time, the pressure of the refrigerant mixing with the water is reduced, and the refrigerant thus gasifies. Further, as the refrigerant the pressure of which is higher than that of the water mixes into the water, the inner pressure of the water circuit 210 is increased.

The refrigerant mixed in the water in the water circuit 210 in the load-side heat exchanger 2 flows not only in a direction from the load-side heat exchanger 2 toward the booster heater 54, which is along the a normal flow of water, but also in a direction from the load-side heat exchanger 2 toward the joining part 230, which is opposite to the direction of the normal flow of water, because of the difference in pressure between the refrigerant and water. As the main circuit 220 of the water circuit 210 is provided with the pressure relief valve 70 as in Embodiment 1, the refrigerant mixed in the water may be discharged together with the water into the indoor space from the pressure relief valve 70. Further, in the case where the heating circuit-side pipe 82*a* or 82*b* is provided with the pressure relief valve 301 as in Embodiment 1, the refrigerant mixed in the water may be discharged together with the water into the indoor space from the pressure relief valve 301. That is, the pressure relief valves 70 and 301 both are used as valves from which the refrigerant mixed in the water in the water circuit 210 is discharged to the outside of the water circuit 210. In a case where the refrigerant is flammable, when the refrigerant is discharged, there is a risk that a flammable concentration region will be formed in the indoor space.

Figure 4:
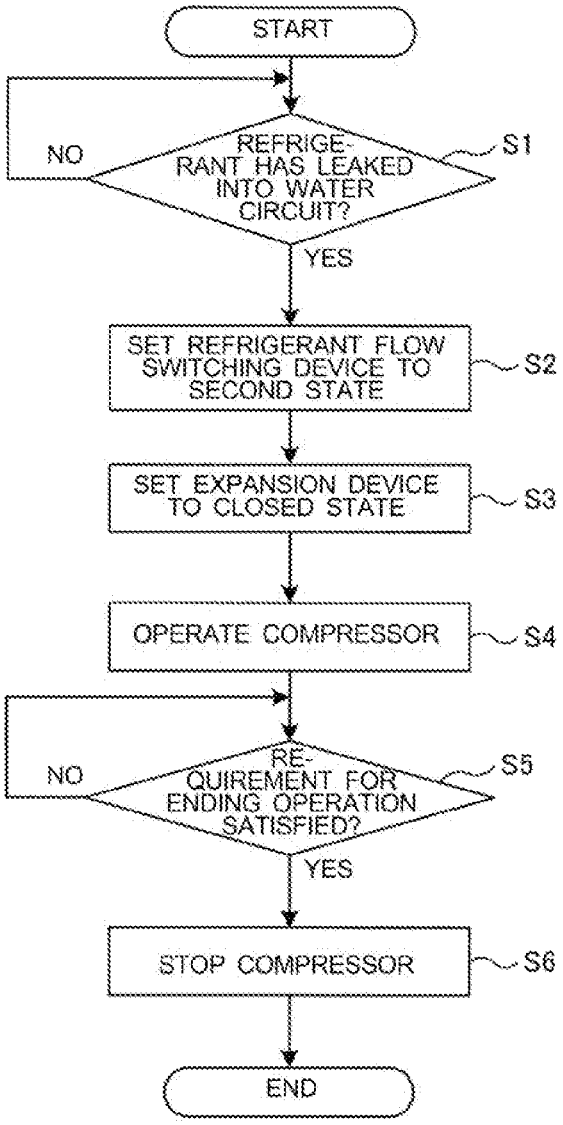
FIG. 4 is a flowchart illustrating an example of a process to be executed by a controller 101 of the apparatus using a heat pump according to Embodiment 1 of the present invention.

In Embodiment 1, when leakage of the refrigerant into the water circuit 210 is detected, a pump-down operation is performed. FIG. 4 is a flowchart illustrating an example of a process to be executed by the controller 101 of the apparatus using a heat pump according to Embodiment 1. The process as illustrated in FIG. 4 is repeatedly executed at intervals of a predetermined time at all times, including during the normal operation, the defrosting operation, and the stopped state of the refrigerant circuit 110.

At step S1 in FIG. 4, the controller 101 determines whether or not the refrigerant has leaked into the water circuit 210 on the basis of a detection signal output from the refrigerant leakage detecting device 98 to the controller 201. When the controller 101 determines that the refrigerant has leaked into the water circuit 210, the process proceeds to step S2.

At step S2, the controller 101 sets the refrigerant flow switching device 4 to the second state (that is, the state of the defrosting operation or the cooling operation). To be more specific, when the refrigerant flow switching device 4 is in the first state, the controller 101 switches the state of the refrigerant flow switching device 4 to the second state from the first state, and when the refrigerant flow switching device 4 is in the second state, the controller 101 keeps the refrigerant flow switching device 4 in the second state.

At step S3, the controller 101 sets the expansion device 6 to a closed state (for example, a fully closed state or a minimum opening-degree state). To be more specific, when the expansion device 6 is in an opened state, the controller 101 switches the state of the expansion device 6 to a closed state from the opened state, and when the expansion device 6 is in a closed state, the controller 101 keeps the expansion device 6 in the closed state.

At step S4, the controller 101 operates the compressor 3. To be more specific, when the compressor 3 is in the stopped state, the controller 101 starts the operation of the compressor 3, and when the compressor 3 is in operation, the controller 101 keeps the compressor 3 in operation. At step S4, the controller 101 may start measurement of a continuous operation time or an accumulated operation time of the compressor 3.

By executing the process of steps S2, S3, and S4, the pump-down operation of the refrigerant circuit 110 is performed, and thereby the refrigerant in the refrigerant circuit 110 is retrieved into the heat-source-side heat exchanger 1. At this time, the outdoor fan 7 may be operated to promote condensation and liquefaction of the refrigerant in the heat-source-side heat exchanger 1. The execution order of steps S2, S3, and S4 is changeable. Furthermore, in the case where the refrigerant circuit 110 does not include the refrigerant flow switching device 4 and is a circuit dedicated to cooling, the process of step S2 is not needed.

When the operation of the refrigerant circuit 110 is switched from the heating operation to the cooling operation or the defrosting operation, the compressor 3 is typically temporarily stopped to equalize the inner pressure of the refrigerant circuit 110. After the inner pressure of the refrigerant circuit 110 is equalized, the state of the refrigerant flow switching device 4 is switched from the first state to the second state, and the compressor 3 is restarted. However, in Embodiment 1, when leakage of the refrigerant into the water circuit 210 is detected during the heating operation, the state of the refrigerant flow switching device 4 is switched from the first state to the second state while the compressor 3 is kept in operation, without stopping the compressor 3. As a result, the refrigerant in the refrigerant circuit 110 can be retrieved early, and the amount of refrigerant leaking into the water circuit 210 can thus be reduced to a small amount.

During the pump-down operation, the controller 101 repeatedly determines whether or not a predetermined requirement (which will be described later) for ending the operation of the compressor 3 is satisfied (step S5). When the controller 101 determines that the condition for ending the operation of the compressor 3 is satisfied, the controller 101 stops the compressor 3 (step S6) and also stops the outdoor fan 7. Consequently, the pump-down operation of the refrigerant circuit 110, that is, the retrieval of the refrigerant is ended. The retrieved refrigerant is stored in a section (mainly in the heat-source-side heat exchanger 1) from the expansion device 6 to the first blocking device (e.g., the opening and closing valve 77) through the heat-source-side heat exchanger 1 in the refrigerant circuit 110. To prevent the retrieved refrigerant from flowing out from the abovementioned section to a side of the load-side heat exchanger 2, the controller 101 may close the opening and closing valves 77 and 78 when the controller 101 determines that the condition for ending the operation of the compressor 3 is satisfied. In the case where the opening and closing valves 77 and 78 are manual valves, the user or a maintenance technician may close the opening and closing valves 77 and 78 after ending of the pump-down operation, with reference to information displayed on the display 203 or an operation procedure described in a manual. Thereby, the retrieved refrigerant can be confined in the abovementioned section.

In place of or in addition to the opening and closing valve 77, a check valve provided at a position at which the refrigerant constantly flows in a fixed direction may be used as the first blocking device. For example, a check valve provided at the suction pipe 11*a* or the discharge pipe 11*b* between the refrigerant flow switching device 4 and the compressor 3 may be used as the first blocking device, or the discharge valve 39 provided at the compressor 3 may be used as the first blocking device. In the case where the check valve or the discharge valve 39 is used as the first blocking device, control for closing the first blocking device is not needed.

The requirement for ending the operation of the compressor 3 will be described. The requirement for ending the operation of the compressor 3 is, for example, a requirement that the continuous operation time or the accumulated operation time of the compressor 3 reaches a threshold time. The continuous operation time of the compressor 3 is time in which the compressor 3 is continuously operated after execution of the process of step S4. The accumulated operation time of the compressor 3 is accumulated time in which the compressor 3 is operated after execution of the process of step S4. To adequately retrieve the refrigerant, the threshold time is set for each of devices depending on, for example, the capacity of the heat-source-side heat exchanger 1, the lengths of the refrigerant pipes in the refrigerant circuit 110 (including the extension pipes 111 and 112), or the amount of refrigerant enclosed in the refrigerant circuit 110.

The requirement for ending the operation of the compressor 3 may be set as a requirement that the inner pressure of the water circuit 210 falls below a first threshold pressure or is on a downward trend. In the case where the inner pressure of the water circuit 210 satisfies one of these requirements, it can be determined that leakage of the refrigerant into the water circuit 210 is controlled by retrieval of refrigerant by the pump-down operation.

The requirement for ending the operation of the compressor 3 may be set as a requirement that the pressure on a low-pressure side of the refrigerant circuit 110 falls below a threshold pressure. In this case, a pressure sensor or a pressure switch (in this case, a low-pressure switch) is provided at part of the refrigerant circuit 110 at which the pressure is reduced to a low level during the pump-down operation. When the refrigerant is retrieved, the pressure on the low-pressure side of the refrigerant circuit 110 is reduced to a low level. It is therefore possible to determine that the refrigerant is sufficiently retrieved when the pressure on the low-pressure side of the refrigerant circuit 110 falls below the threshold pressure. In an air-conditioning apparatus, when the inner pressure of a refrigerant circuit falls below atmospheric pressure, there is a possibility that air will be sucked into the refrigerant circuit. By contrast, in Embodiment 1, even when the inner pressure of the refrigerant circuit 110 falls below atmospheric pressure, the refrigerant circuit 110 merely sucks water in the water circuit 210, and rarely sucks air. Consequently, the above threshold pressure may be set to a pressure lower than atmospheric pressure.

The requirement for ending the operation of the compressor 3 may be set as a requirement that a high-pressure side pressure of the refrigerant circuit 110 exceeds a threshold pressure. In this case, a pressure sensor or a pressure switch (in this case, a high-pressure switch) is provided at part of the refrigerant circuit 110 at which the pressure is increased to a high level during the pump-down operation. When the refrigerant is retrieved, the pressure on the high-pressure side of the refrigerant circuit 110 is increased to a high level.

It is therefore possible to determine that the refrigerant is sufficiently retrieved when the pressure on the high-pressure side of the refrigerant circuit 110 exceeds the threshold pressure.

When the inner pressure of the water circuit 210 exceeds a second threshold pressure or is on an upward trend after ending of the pump-down operation of the refrigerant circuit 110, the compressor 3 and the outdoor fan 7 may be operated again, and the pump-down operation of the refrigerant circuit 110 may be resumed. In any of the expansion device 6, the opening and closing valves 77 and 78, and the discharge valve 39, a foreign substance caught may cause slight leakage of refrigerant. Consequently, the retrieved refrigerant may leak into the water circuit 210 via the load-side heat exchanger 2. Consequently, to reduce leakage of refrigerant, it is effective that, even after the pump-down operation is once ended, the pump-down operation is resumed depending on the pressure in the water circuit 210. For example, the second threshold pressure is set to be higher than the first threshold pressure.

Note that the refrigerant may be confined in the section between the expansion device 6 and the first blocking device without retrieving the refrigerant by the pump-down operation. In this case, when the leakage of the refrigerant into the water circuit 210 is detected, the controller 101 stops the compressor 3, sets the refrigerant flow switching device 4 to the second state, and sets the expansion device 6 to a closed state. In this case also, it is possible to reduce the amount of refrigerant leaking into the water circuit 210, and thus prevent leakage of the refrigerant into the indoor space.

Figure 5:
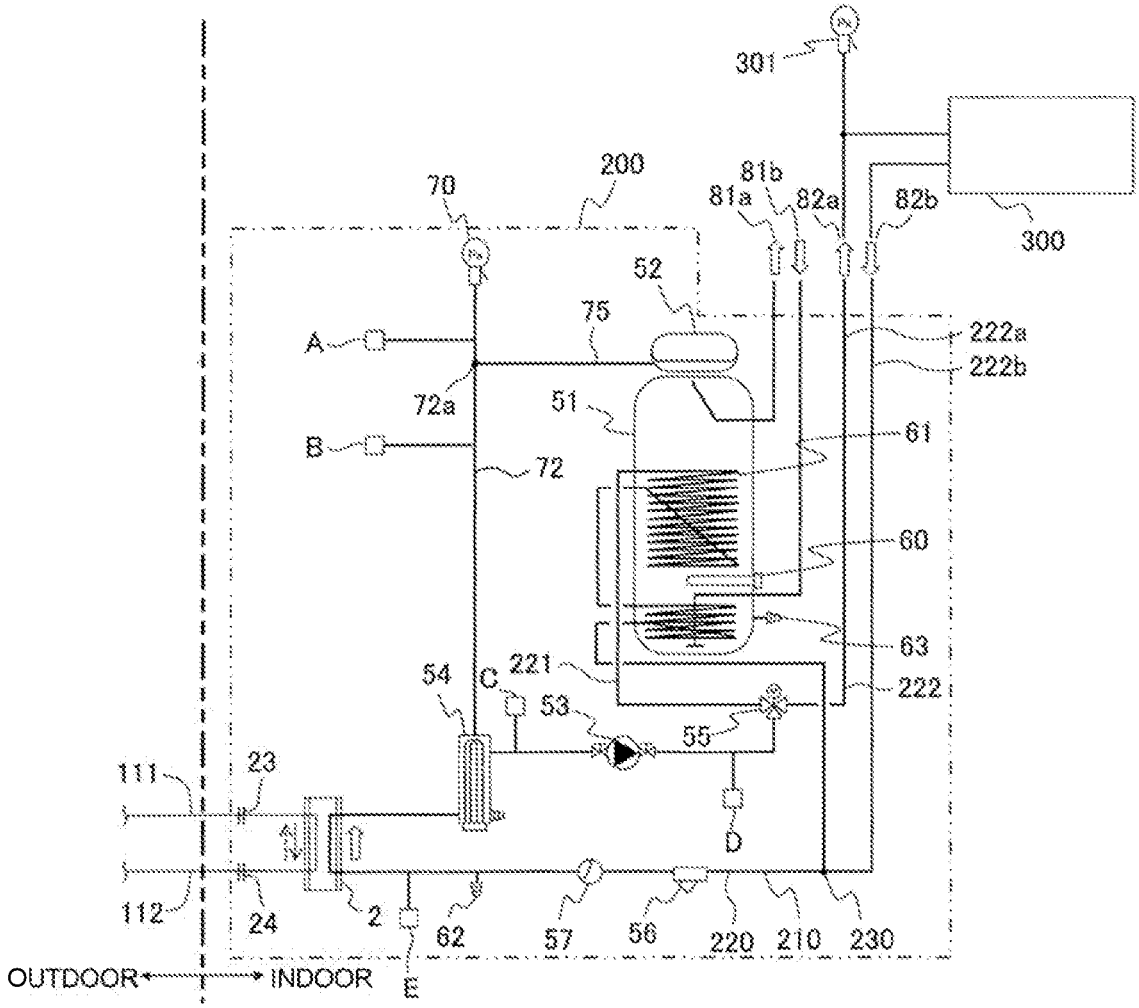
FIG. 5 is an explanatory diagram illustrating examples of the position of a refrigerant leakage detecting device 98 provided in the apparatus using a heat pump according to Embodiment 1 of the present invention.

Next, the installation position of the refrigerant leakage detecting device 98 will be described. FIG. 5 is an explanatory diagram illustrating examples of the position of the refrigerant leakage detecting device 98 provided in the apparatus using a heat pump according to Embodiment 1. FIG. 5 illustrates five positions A to E as examples of the installation positions of the refrigerant leakage detecting device 98. In the case where the refrigerant leakage detecting device 98 is provided at the position A or B, the refrigerant leakage detecting device 98 is connected to the pipe 72. That is, the refrigerant leakage detecting device 98 is connected to the main circuit 220 via the booster heater 54 as with the case of the pressure relief valve 70. In such as case, the refrigerant leakage detecting device 98 can reliably detect leakage of the refrigerant before the refrigerant that has leaked into the water circuit 210 in the load-side heat exchanger 2 is discharged from the pressure relief valve 70. When the leakage of the refrigerant into the water circuit 210 is detected by the refrigerant leakage detecting device 98, the pump-down operation of the refrigerant circuit 110 is immediately started to retrieve the refrigerant. It is therefore possible to minimize the amount of refrigerant that leaks into the indoor space from the pressure relief valve 70. The same advantage as described above can be also obtained in the case where the refrigerant leakage detecting device 98 is connected to the load-side heat exchanger 2 or between the load-side heat exchanger 2 and the booster heater 54 (that is, the connection part) in the main circuit 220, as illustrated in FIG. 1.

Meanwhile, in the case where the refrigerant leakage detecting device 98 is provided at the position C or D, the refrigerant leakage detecting device 98 is connected between the booster heater 54 and the three-way valve 55 in the main circuit 220. In this case, the refrigerant may be discharged from the pressure relief valve 70 before the refrigerant leakage detecting device 98 detects the leakage of the refrigerant. However, when the leakage of the refrigerant into the water circuit 210 is detected, the pump-down operation of the refrigerant circuit 110 is immediately started, as described above, and the refrigerant is retrieved. It is therefore possible to prevent a large amount of refrigerant from leaking into the indoor space from the pressure relief valve 70.

In the case where the refrigerant leakage detecting device 98 is provided at the position E, the refrigerant leakage detecting device 98 is connected between the load-side heat exchanger 2 and the joining part 230 in the main circuit 220. In this case, the refrigerant leakage detecting device 98 can reliably detect leakage of the refrigerant before the refrigerant that has leaked into the water circuit 210 is discharged from the pressure relief valve 301 provided outside the indoor unit 200. When the leakage of the refrigerant into the water circuit 210 is detected by the refrigerant leakage detecting device 98, the pump-down operation of the refrigerant circuit 110 is immediately started to retrieve the refrigerant. Consequently, it is possible to minimize the amount of refrigerant that leaks into the indoor space from the pressure relief valve 301.

In all the configurations as illustrated in FIGS. 1 and 5, the refrigerant leakage detecting device 98 is connected to the main circuit 220, not to a branch circuit (for example, the heating circuit-side pipes 82*a* and 82*b*, and the heating apparatus 300) installed by a technician in the actual place. Thus, the refrigerant leakage detecting device 98 can be attached and the refrigerant leakage detecting device 98 and the controller 201 can be connected to each other by a manufacturer of the indoor unit 200. It is therefore possible to avoid human errors, such as a failure to attach the refrigerant leakage detecting device 98 and a failure to connect the refrigerant leakage detecting device 98 and the controller 201.

As described above, the heat pump hot-water supply heating apparatus 1000 (an example of the apparatus using a heat pump) according to Embodiment 1 includes the refrigerant circuit 110 that includes the compressor 3, the refrigerant flow switching device 4, the heat-source-side heat exchanger 1, the expansion device 6, and the load-side heat exchanger 2, and circulates refrigerant, and the water circuit 210 (an example of the heat medium circuit) that causes water (an example of the heat medium) to flow via the load-side heat exchanger 2. The refrigerant flow switching device 4 is configured in such a manner that a state of the refrigerant flow switching device 4 is switchable between the first state and the second state. When the state of the refrigerant flow switching device 4 is switched to the first state, the normal operation (an example of the first operation) in which the load-side heat exchanger 2 is used as a condenser can be executed in the refrigerant circuit 110. When the state of the refrigerant flow switching device 4 is switched to the second state, the defrosting operation (an example of the second operation) in which the load-side heat exchanger 2 is used as an evaporator can be executed in the refrigerant circuit 110. The water circuit 210 includes the main circuit 220 extending via the load-side heat exchanger 2. The main circuit 220 includes the three-way valve 55 (an example of the branching part) that is provided at a downstream end of the main circuit 220 and to which the plurality of branch circuits 221 and 222 branching off from the main circuit 220 are connected, and the joining part 230 that is provided at an upstream end of the main circuit 220 and to which the plurality of branch circuits 221 and 222 joining to the main circuit 220 are connected. The pressure relief valve 70 (an example of the overpressure protection device) and the refrigerant leakage detecting device 98 are connected to the main circuit 220. The pressure relief valve 70 is connected to a connection part (the booster heater 54 in Embodiment 1) that is located between the load-side heat exchanger 2 and one of the three-way valve 55 and the joining part 230 (the three-way valve 55 in Embodiment 1) in the main circuit 220 or at the load-side heat exchanger 2 in the main circuit 220. The refrigerant leakage detecting device 98 is connected to the other of the three-way valve 55 and the joining part 230 (the joining part 230 in Embodiment 1) in the main circuit 220, between the booster heater 54 and the other of the three-way valve 55 and the joining part 230 in the main circuit 220, or at the booster heater 54. When leakage of the refrigerant into the water circuit 210 is detected, the refrigerant flow switching device 4 is set to the second state, the expansion device 6 is set to a closed state, and the compressor 3 is made in operation.

With this configuration, in the case where the refrigerant leaks into the water circuit 210, the refrigerant leakage detecting device 98 can early detect the leakage of the refrigerant into the water circuit 210. When the leakage of the refrigerant into the water circuit 210 is detected, the refrigerant in the refrigerant circuit 110 is retrieved by the pump-down operation. As the leakage of the refrigerant is earlier detected, the refrigerant is also earlier retrieved. It is therefore possible to prevent or reduce leakage of the refrigerant into the indoor space.

In the heat pump hot-water supply heating apparatus 1000 according to Embodiment 1, the refrigerant circuit 110 further includes a blocking device (e.g., the first blocking device, the opening and closing valve 77, the discharge valve 39, or a check valve). The blocking device is provided, in the refrigerant circuit 110, between the load-side heat exchanger 2 and the refrigerant flow switching device 4, at the suction pipe 11*a* between the refrigerant flow switching device 4 and the compressor 3, at the discharge pipe 11*b* between the refrigerant flow switching device 4 and the compressor 3, between the refrigerant flow switching device 4 and the heat-source-side heat exchanger 1, or at the compressor 3. With this configuration, refrigerant can be confined in the section from the expansion device 6 to the blocking device through the heat-source-side heat exchanger 1 after ending of the pump-down operation. It is therefore possible to prevent or reduce leakage of the refrigerant into the indoor space after ending of the pump-down operation.

In the heat pump hot-water supply heating apparatus 1000 according to Embodiment 1, the blocking device of the refrigerant circuit 110 is provided, in the refrigerant circuit 110, at the suction pipe 11*a* between the refrigerant flow switching device 4 and the compressor 3, at the discharge pipe 11*b* between the refrigerant flow switching device 4 and the compressor 3, or at the compressor 3. The blocking device is a check valve (for example, a check valve that allows flow of refrigerant to be sucked into the compressor 3 or flow of refrigerant discharged from the compressor 3, and prevents backflow of the refrigerant). With this configuration, refrigerant can be confined in the section from the expansion device 6 to the blocking device through the heat-source-side heat exchanger 1 after ending of the pump-down operation. It is therefore possible to prevent or reduce leakage of the refrigerant into the indoor space after ending of the pump-down operation.

Furthermore, the heat pump hot-water supply heating apparatus 1000 (an example of the apparatus using a heat pump) according to Embodiment 1 includes the refrigerant circuit 110 that includes the compressor 3, the heat-source-side heat exchanger 1 that is used as a condenser, the expansion device 6, and the load-side heat exchanger 2 that is used as an evaporator, and circulates refrigerant, and the water circuit 210 (an example of the heat medium circuit) that causes water (an example of the heat medium) to flow via the load-side heat exchanger 2. The water circuit 210 includes the main circuit 220 extending via the load-side heat exchanger 2. The main circuit 220 includes the three-way valve 55 (an example of the branching part) that is provided at a downstream end of the main circuit 220 and to which the plurality of branch circuits 221 and 222 branching off from the main circuit 220 are connected, and the joining part 230 that is provided at an upstream end of the main circuit 220 and to which the plurality of branch circuits 221 and 222 joining to the main circuit 220 are connected. The pressure relief valve 70 (an example of the overpressure protection device) and the refrigerant leakage detecting device 98 are connected to the main circuit 220. The pressure relief valve 70 is connected to a connection part (the booster heater 54 in Embodiment 1) that is located between the load-side heat exchanger 2 and one of the three-way valve 55 and the joining part 230 (the three-way valve 55 in Embodiment 1) in the main circuit 220 or at the load-side heat exchanger 2 in the main circuit 220. The refrigerant leakage detecting device 98 is connected to the other of the three-way valve 55 and the joining part 230 (the joining part 230 in Embodiment 1) in the main circuit 220, between the booster heater 54 and the other of the three-way valve 55 and the joining part 230 in the main circuit 220, or at the booster heater 54. When leakage of the refrigerant into the water circuit 210 is detected, the expansion device 6 is set to a closed state, and the compressor 3 is made in operation.

With this configuration, in the case where the refrigerant leaks into the water circuit 210, the refrigerant leakage detecting device 98 can early detect the leakage of the refrigerant into the water circuit 210. When the leakage of the refrigerant into the water circuit 210 is detected, the refrigerant in the refrigerant circuit 110 is retrieved by the pump-down operation. As the leakage of the refrigerant is earlier detected, the refrigerant is also earlier retrieved. It is therefore possible to prevent or reduce leakage of the refrigerant into the indoor space.

In the heat pump hot-water supply heating apparatus 1000 according to Embodiment 1, the refrigerant circuit 110 further includes a blocking device (e.g., the first blocking device, the opening and closing valve 77, or a check valve). The blocking device is provided, in the refrigerant circuit 110, between the load-side heat exchanger 2 and the compressor 3, between the compressor 3 and the heat-source-side heat exchanger 1, or at the compressor 3. With this configuration, refrigerant can be confined in the section from the expansion device 6 to the blocking device through the heat-source-side heat exchanger 1 after ending of the pump-down operation. It is therefore possible to prevent or reduce leakage of the refrigerant into the indoor space after ending of the pump-down operation.

In the heat pump hot-water supply heating apparatus 1000 according to Embodiment 1, the blocking device is a check valve that allows flow of refrigerant to be sucked into the compressor 3 or flow of refrigerant discharged from the compressor 3, and prevents backflow of the refrigerant. With this configuration, control for closing the blocking device is not needed.

In the heat pump hot-water supply heating apparatus 1000 according to Embodiment 1, the check valve may be the discharge valve 39 provided at the compressor 3 or a check valve 47 (which will be described later) provided at the compressor 3.

In the heat pump hot-water supply heating apparatus 1000 according to Embodiment 1, the compressor 3 may be configured in such a manner that, when a requirement for ending an operation is satisfied, the compressor 3 in operation is stopped.

In the heat pump hot-water supply heating apparatus 1000 according to Embodiment 1, the requirement for ending the operation may be a requirement that the pressure of the water circuit 210 falls below a first threshold pressure or the pressure of the water circuit 210 is on a downward trend.

In the heat pump hot-water supply heating apparatus 1000 according to Embodiment 1, when the pressure of the water circuit 210 exceeds a second threshold pressure or when the pressure of the water circuit 210 is on an upward trend, the compressor 3 in a stopped state is restarted. With this configuration, it is possible to prevent or reduce leakage of the retrieved refrigerant into the water circuit 210.

Embodiment 2

An apparatus using a heat pump according to Embodiment 2 of the present invention will be described. FIG. 6 is a circuit diagram illustrating a schematic configuration of an apparatus using a heat pump according to Embodiment 2. Note that component elements that are similarly used and have the same advantages as do those of Embodiment 1 will be denoted by the same reference signs, and their descriptions will thus be omitted. In the refrigerant circuit 110 of Embodiment 2, a container 8 (e.g., a receiver) for storing refrigerant is provided between the heat-source-side heat exchanger 1 and the expansion device 6.

FIG. 7 is a sectional view illustrating a schematic configuration of the compressor 3 of the apparatus using a heat pump according to Embodiment 2. The compressor 3 of Embodiment 2 is a sealed and high-pressure shell scroll compressor. As illustrated in FIG. 7, the compressor 3 includes the compression mechanism unit 30 that sucks and compresses refrigerant, the electric motor unit 31 that drives the compression mechanism unit 30, and the sealed container 32 that houses the compression mechanism unit 30 and the electric motor unit 31. The compression mechanism unit 30 is provided at an upper part in the sealed container 32. The electric motor unit 31 is provided below the compression mechanism unit 30 in the sealed container 32. The space in the sealed container 32 is filled with high-pressure refrigerant compressed by the compression mechanism unit 30. The sealed container 32 is connected to a suction pipe 44 through which low-pressure refrigerant is sucked and a discharge pipe 45 through which the high-pressure refrigerant is discharged.

The compression mechanism unit 30 includes a frame 41 fixed to the sealed container 32, a fixed scroll 42 supported by the frame 41, and an orbiting scroll 43 that oscillates with respect to the fixed scroll 42 by a rotational driving force of the electric motor unit 31 transmitted via a main shaft. Between a scroll lap of the fixed scroll 42 and a scroll lap of the orbiting scroll 43, there are provided a suction process chamber that communicates with the suction pipe 44, a compression process chamber in which the refrigerant sucked via the suction pipe 44 is compressed, and a discharge process chamber that communicates with the space in the sealed container 32 via a discharge hole 46. By driving the orbiting scroll 43 by the electric motor unit 31, a suction process, a compression process, and a discharge process are continuously repeated.

A check valve 47 is provided between the suction pipe 44 and the suction process chamber. The check valve 47 includes a valve body that opens and closes a suction passage for the refrigerant, and a spring that urges the valve body in a closing direction from a downstream side of the refrigerant flow. While the compressor 3 is in operation, a force acting on the valve body is increased to be greater than the urging force of the spring by the flow of the sucked refrigerant, thus causing the check valve 47 to be in an opened state. While the compressor 3 is in a stopped state, the check valve 47 is set to a closed state by the urging force of the spring. The check valve 47 is configured to prevent a reverse operation of the compression mechanism unit 30 and a backflow of refrigerating machine oil, which occur due to a pressure difference, when the compressor 3 is stopped. Normally, the pressure difference made when the compressor 3 is stopped is eliminated by opening the expansion device 6. Note that the scroll compressor may also include a discharge valve. The check valve 47 or the discharge valve provided in the compressor 3 can be used as the first blocking device.

In Embodiment 2, when leakage of the refrigerant into the water circuit 210 is detected, the pump-down operation, which is the same as in Embodiment 1, is performed (see FIG. 4). In Embodiment 2, as the container 8 is provided between the heat-source-side heat exchanger 1 and the expansion device 6, the retrieved refrigerant can be stored also in the container 8. Consequently, according to Embodiment 2, it is possible to store more refrigerant than that in Embodiment 1 by the volume of the container 8 in the section from the expansion device 6 to the first blocking device (e.g., the check valve 47 or the opening and closing valve 77) through the heat-source-side heat exchanger 1.

The present invention is not limited to Embodiments 1 and 2 described above, and may be modified in various manners.

For example, although the plate heat exchanger is described in the above embodiments as an example of the load-side heat exchanger 2, a heat exchanger other than the plate heat exchanger, such as a double-pipe heat exchanger, may be used as the load-side heat exchanger 2, as long as the heat exchanger causes heat exchange to be performed between the refrigerant and the heat medium.

Also, although the heat pump hot-water supply heating apparatus 1000 is described in the above embodiments as an example of the apparatus using a heat pump, the present invention is also applicable to other apparatuses using heat pumps, such as a chiller.

Furthermore, although the indoor unit 200 provided with the hot-water storage tank 51 is described in the above embodiments as an example, a hot-water storage tank may be provided separately from the indoor unit 200.

In addition, although the configuration in which the load-side heat exchanger 2 is housed in the indoor unit 200 is described in the above embodiments as an example, the load-side heat exchanger 2 may be housed in the outdoor unit 100. In this case where the load-side heat exchanger 2 is housed in the outdoor unit 100, the entire refrigerant circuit 110 is housed in the outdoor unit 100, and, in addition, the outdoor unit 100 and the indoor unit 200 are connected to each other via two water pipes that forms part of the water circuit 210.

Embodiments 1 and 2 can be combined together and put to practical use.

REFERENCE SIGNS LIST

1 heat-source-side heat exchanger 2 load-side heat exchanger 3 compressor 4 refrigerant flow switching device

6 expansion device 7 outdoor fan 8 container 11*a* suction pipe 11*b* discharge pipe 21, 22, 23, 24 joint unit 30 compression mechanism unit 31 electric motor unit 32 sealed container 33 cylinder 34 rolling piston 35 upper end plate 36 lower end plate 37 suction pipe 38 discharge hole 39 discharge valve 40 valve stopper 41 frame 42 fixed scroll 43 orbiting scroll 44 suction pipe 45 discharge pipe 46 discharge hole 47 check valve 51 hot-water storage tank expansion tank 53 pump 54 booster heater 55 three-way valve 56 strainer 57 flow switch 60 immersion heater 61 coil 62, 63 drain outlet 70 pressure relief valve 72 pipe 72*a* branching part 75 pipe 77, 78 opening and closing valve 81*a*, 81*b* sanitary circuit-side pipe 82*a*, 82*b* heating circuit-side pipe 98 refrigerant leakage detecting device 100 outdoor unit 101 controller 102 control line 110 refrigerant circuit 111, 112 extension pipe 200 indoor unit 201 controller 202 operation unit 203 display 210 water circuit 220 main circuit 221, 222 branch circuit 222*a* supply pipe 222*b* return pipe 230 joining part 300 heating apparatus 301 pressure relief valve 1000 heat pump hot-water supply heating apparatus

The invention claimed is:

1. An apparatus using a heat pump, the apparatus comprising:

a refrigerant circuit including a compressor, a refrigerant flow switcher, a heat-source-side heat exchanger, an expansion device, and a load-side heat exchanger, the refrigerant circuit being configured to circulate refrigerant; and a heat medium circuit configured to cause a heat medium to flow via the load-side heat exchanger, the refrigerant flow switcher being configured in such a manner that a state of the refrigerant flow switcher is switchable between a first state and a second state, the refrigerant circuit being configured to perform a first operation in which the load-side heat exchanger is used as a condenser in response to the state of the refrigerant flow switcher being switched to the first state, the refrigerant circuit being configured to perform a second operation in which the load-side heat exchanger is used as an evaporator in response to the state of the refrigerant flow switcher being switched to the second state, the heat medium circuit including a main circuit extending via the load-side heat exchanger, the main circuit including a branching part provided at a downstream end of the main circuit, the branching part being a part at which a plurality of branch circuits that branch off from the main circuit are connected, and a joining part provided at an upstream end of the main circuit, the joining part being a part at which the plurality of branch circuits are connected to join the main circuit, to the main circuit, an overpressure protector and a refrigerant leakage detector being connected, the refrigerant leakage detector being configured to detect leakage of the refrigerant into the heat medium circuit, in the main circuit, the overpressure protector being connected to a connection part that is located between the load-side heat exchanger and one of the branching part and the joining part or at the load-side heat exchanger, in the main circuit, the refrigerant leakage detector being connected to an other of the branching part and the joining part, between the connection part and the other of the branching part and the joining part, or at the connection part, wherein the refrigerant flow switcher is configured to be set to the second state, the expansion device is configured to be set to a closed state, and the compressor is configured to be operated in response to the refrigerant leakage detector detecting leakage of the refrigerant into the heat medium circuit, and wherein the refrigerant circuit is configured to subsequently stop the operation of the compressor in response to a pressure of the heat medium circuit falling below a first threshold pressure or a pressure of the heat medium circuit being on a downward trend.

2. The apparatus using a heat pump of claim 1, wherein the refrigerant circuit further includes a blocker that is provided, in the refrigerant circuit, between the load-side heat exchanger and the refrigerant flow switcher, at a suction pipe between the refrigerant flow switcher and the compressor, at a discharge pipe between the refrigerant flow switcher and the compressor, between the refrigerant flow switcher and the heat-source-side heat exchanger, or at the compressor.

3. The apparatus using a heat pump of claim 1, wherein the refrigerant circuit further includes a blocker that is provided, in the refrigerant circuit, at a suction pipe between the refrigerant flow switcher and the compressor, at a discharge pipe between the refrigerant flow switcher and the compressor, or at the compressor, and that is a check valve.

4. An apparatus using a heat pump, the apparatus comprising:

a refrigerant circuit including a compressor, a heat-source-side heat exchanger that is used as a condenser, an expansion device, and a load-side heat exchanger that is used as an evaporator, the refrigerant circuit being configured to circulate refrigerant; and a heat medium circuit configured to cause a heat medium to flow via the load-side heat exchanger, the heat medium circuit including a main circuit extending via the load-side heat exchanger, the main circuit including a branching part provided at a downstream end of the main circuit, the branching part being a part at which a plurality of branch circuits that branch off from the main circuit are connected, and a joining part provided at an upstream end of the main circuit, the joining part being a part at which the plurality of branch circuits are connected to join the main circuit, to the main circuit, an overpressure protector and a refrigerant leakage detector being connected, the refrigerant leakage detector being configured to detect leakage of the refrigerant into the heat medium circuit, in the main circuit, the overpressure protector being connected to a connection part that is located between the load-side heat exchanger and one of the branching part and the joining part or at the load-side heat exchanger, in the main circuit, the refrigerant leakage detector being connected to an other of the branching part and the joining part, between the connection part and the other of the branching part and the joining part, or at the connection part, the expansion device being set to a closed state and the compressor being made in operation, when the refrigerant leakage detector detects leakage of the refrigerant into the heat medium circuit, wherein the refrigerant leakage detector is configured to detect a leakage of the refrigerant into the heat medium circuit in response to a value selected from one of an inner pressure of the heat medium circuit and a change of the inner pressure of the heat medium circuit with time.

5. The apparatus using a heat pump of claim 4, wherein the refrigerant circuit further includes a blocker that is provided, in the refrigerant circuit, between the load-side heat exchanger and the compressor, between the compressor and the heat-source-side heat exchanger, or at the compressor.

6. The apparatus using a heat pump of claim 5, wherein the blocker is a check valve.

7. The apparatus using a heat pump of claim 3, wherein the check valve is a discharge valve provided at the compressor or a check valve provided at the compressor.

8. The apparatus using a heat pump of claim 1, wherein, when a pressure of the heat medium circuit exceeds a second threshold pressure or when a pressure of the heat medium circuit is on an upward trend, the compressor that is in a stopped state is restarted.

9. The apparatus using a heat pump of claim 4, wherein, when a requirement for ending an operation is satisfied, the compressor that is in operation is stopped.

10. The apparatus using a heat pump of claim 9, wherein the requirement for ending the operation is a requirement that a pressure of the heat medium circuit falls below a first threshold pressure or is on a downward trend.

11. The apparatus using a heat pump of claim 9, wherein, when a pressure of the heat medium circuit exceeds a second threshold pressure or when a pressure of the heat medium circuit is on an upward trend, the compressor that is in a stopped state is restarted.

12. An apparatus using a heat pump, the apparatus comprising:

a refrigerant circuit including a compressor, a refrigerant flow switcher, a heat-source-side heat exchanger, an expansion device, and a load-side heat exchanger, the refrigerant circuit being configured to circulate refrigerant; and a heat medium circuit configured to cause a heat medium to flow via the load-side heat exchanger, the refrigerant flow switcher being configured in such a manner that a state of the refrigerant flow switcher is switchable between a first state and a second state, the refrigerant circuit being configured to perform a first operation in which the load-side heat exchanger is used as a condenser, in response to the state of the refrigerant flow switcher being switched to the first state, the refrigerant circuit being configured to perform a second operation in which the load-side heat exchanger is used as an evaporator, in response to the state of the refrigerant flow switcher being switched to the second state, the heat medium circuit including a main circuit extending via the load-side heat exchanger, the main circuit including a branching part provided at a downstream end of the main circuit, the branching part being a part at which a plurality of branch circuits that branch off from the main circuit are connected, and a joining part provided at an upstream end of the main circuit, the joining part being a part at which the plurality of branch circuits are connected to join the main circuit, to the main circuit, an overpressure protector and a refrigerant leakage detector being connected, the refrigerant leakage detector being configured to detect leakage of the refrigerant into the heat medium circuit, in the main circuit, the overpressure protector being connected to a connection part that is located between the load-side heat exchanger and one of the branching part and the joining part or at the load-side heat exchanger, in the main circuit, the refrigerant leakage detector being connected to an other of the branching part and the joining part, between the connection part and the other of the branching part and the joining part, or at the connection part, wherein the refrigerant flow switcher is configured to be set to the second state, the expansion device is configured to be set to a closed state, and the compressor is configured to be operated in response to the refrigerant leakage detector detecting leakage of the refrigerant into the heat medium circuit, and wherein, the refrigerant leakage detector is configured to detect a leakage of the refrigerant into the heat medium circuit in response to a value selected from one of an inner pressure of the heat medium circuit and a change of the inner pressure of the heat medium circuit with time.

* * * * *